US009777908B1

(12) United States Patent
Churnock

(10) Patent No.: US 9,777,908 B1
(45) Date of Patent: Oct. 3, 2017

(54) STRUT CHANNEL RECESSED LIGHTING FIXTURE

(71) Applicant: Amazon Technologies, Inc., Reno, NV (US)

(72) Inventor: Paul Andrew Churnock, Vashon, WA (US)

(73) Assignee: Amazon Technologies, Inc., Seattle, WA (US)

( * ) Notice: Subject to any disclaimer, the term of this patent is extended or adjusted under 35 U.S.C. 154(b) by 223 days.

(21) Appl. No.: 14/192,067

(22) Filed: Feb. 27, 2014

(51) Int. Cl.
*F21V 15/00* (2015.01)
*F21V 21/04* (2006.01)
*F21K 99/00* (2016.01)
*F21S 8/04* (2006.01)

(52) U.S. Cl.
CPC ..... *F21V 21/04* (2013.01); *F21K 9/30* (2013.01); *F21S 8/04* (2013.01); *F21V 21/048* (2013.01)

(58) Field of Classification Search
CPC ..... F21Y 2103/025; F21Y 2103/003; F21S 8/026; F21S 8/02; F21S 48/211; F21S 8/04; F21V 21/048; F21V 21/30; F21V 7/09; F21V 21/04
USPC ..... 362/362, 365, 191, 370, 249.01, 549, 362/249.02, 249.04
See application file for complete search history.

(56) References Cited

U.S. PATENT DOCUMENTS 3,051,772 A * 8/1962 Davis ..... F21V 21/34 138/107
3,504,172 A * 3/1970 Liberman ..... E04B 9/006 362/150
3,719,818 A * 3/1973 Porter ..... F21V 21/34 248/317
4,830,531 A 5/1989 Condit et al.
5,188,479 A 2/1993 Nehls
5,430,627 A * 7/1995 Nagano ..... F21S 4/003 362/146
5,934,786 A * 8/1999 O'Keefe ..... E04B 9/02 362/147
6,074,074 A * 6/2000 Marcus ..... B29C 45/14655 362/234

(Continued)

OTHER PUBLICATIONS

Bolted Framing (Strut Systems). Datasheet [online]. Eaton B-Line Business, 2013 [retrieved on Feb. 20, 2014]. Retrieved from the Internet: <URL: http://www.cooperindustries.com/content/public/en/b-line/resources/Library/Literature/Catalogs/Bolted_Framing.html>, 8 pages.

(Continued)

*Primary Examiner* — Tsion Tumebo
(74) *Attorney, Agent, or Firm* — Kilpatrick Townsend & Stockton LLP

(57) ABSTRACT

Embodiments herein are directed to a lighting fixture for insertion into a strut channel member. In an installed position, a light source supported by the housing of the lighting fixture is disposed at least partially within an interior volume of the strut channel member. The lighting fixture can be attached to the strut channel member by the lips of the strut channel member. When the lighting fixture is installed in the channel member, light from the light source emanates in a direction out of the channel member through the slot in the channel member. The lighting fixture may be snapped or slid into or out of place in the channel member.

23 Claims, 3 Drawing Sheets

(56) References Cited

U.S. PATENT DOCUMENTS

| | | | | |
|---|---|---|---|---|
| 6,588,711 | B2 * | 7/2003 | Onishi | F16B 37/045 248/221.11 |
| 8,770,993 | B2 * | 7/2014 | Gingrich, III | H01R 25/142 439/121 |
| 2006/0262521 | A1 * | 11/2006 | Piepgras | E04B 9/006 362/149 |
| 2008/0106892 | A1 * | 5/2008 | Griffiths | F21V 11/10 362/223 |
| 2010/0103654 | A1 * | 4/2010 | Yasuda | E04B 9/006 362/147 |

OTHER PUBLICATIONS

Strut Systems. Catalog [online]. Eaton B-Line Business, 2013 [retrieved on Feb. 20, 2014]. Retrieved from the Internet: <URL: http://www.cooperindustries.com/content/dam/public/bline/Resources/Library/catalogs/bolted_framing/strut_systems/SS-13.pdf>, 256 pages.

Unistrut®—The Original Metal Framing System—Featuring the Unique Weldless Connection. Datasheet [online]. Atkore International, Inc, 2013 [retrieved on Feb. 20, 2014]. Retrieved from the Internet: <URL: http://www.unistrut.us/index.php?WP=about_overview>, 1 page.

* cited by examiner

STRUT CHANNEL RECESSED LIGHTING FIXTURE

BACKGROUND

Lighting systems provide a number of benefits within buildings and other structures commonly used by people. For example, lighting systems can improve a worker's ability to see within the structure or building. Improved visibility can improve safety by making it easier for a worker to see and avoid hazards. Additionally, improved visibility can yield increased efficiency as a worker may be able to work more quickly when objects relevant to the worker's task are more readily seen, found, and identified due to improved lighting.

Various challenges may arise with lighting systems, however. For example, a building or structure may have limited space in which adequate lighting systems can be installed. Additionally, varying sizes and weights of lighting fixtures can necessitate complex or onerous installation and/or fixation procedures. While standardized and easily customizable support systems—such as support systems commonly referred to as strut systems—may reduce the complexity of installing and/or maintaining a variety of lighting systems, additional improvements can reduce the cost, time, and complexity of installing and/or maintaining lighting systems.

BRIEF DESCRIPTION OF THE DRAWINGS

The specification makes reference to the following appended figures, in which use of like reference numerals in different figures may illustrate like or analogous components. Various embodiments in accordance with the present disclosure will be described with reference to figures in the drawings, in which.

DETAILED DESCRIPTION

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Embodiments herein are directed to lighting systems including a lighting fixture insert formed for insertion into a standardized support member, such as an industry-standard 4.127 cm-wide (1⅝ in.) strut channel member. Lighting fixture inserts may include features for engaging features of the channel member, such as prongs or arms for engaging interior surfaces of the lips of the channel member or external flanges for engaging an exterior surface of the lips of the channel member. In some aspects, a lighting fixture insert may snap into an interior of the channel member. In additional or alternative aspects, a lighting fixture insert may slide into a channel member from an end of the channel member. According to varying aspects, the lighting fixture insert can extend along a portion or along an entirety of a length of the channel member. The insert may be utilized in place of conventional light fixtures supported by the channel member and/or used to supplement conventional light fixtures.

In accordance with an embodiment, a lighting system can include a strut member and a recessed lighting fixture. The strut member can include an interior volume, a first inturned lip, a second inturned lip, and a slot disposed between the first inturned lip and the second inturned lip. The slot can define an entry into the interior volume of the strut member. The lighting fixture can include a base and a light emitting diode (LED). The base can include a first arm and a second arm respectively interfering with the first inturned lip and the second inturned lip so as to attach the base to the strut member when the base has been inserted into the slot. The LED can be mounted in the base such that the LED is positioned within the interior volume when the base is attached to the strut member.

Figure 1:
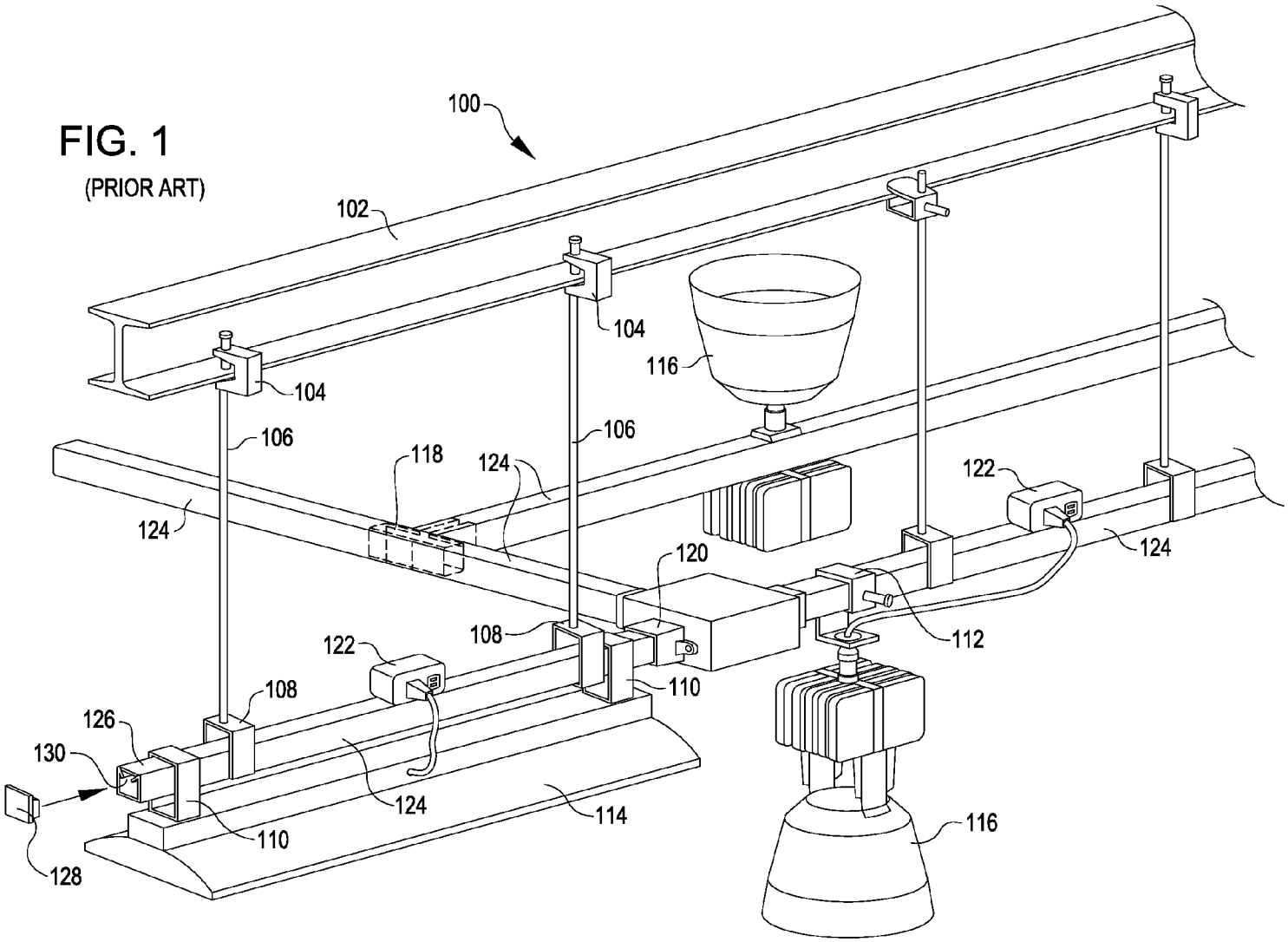
FIG. 1 (PRIOR ART)
FIG. 1 is a perspective view of an example of a conventional lighting system utilizing strut members.

A preliminary discussion of components commonly used in conventional lighting systems may be useful as additional background and/or context for embodiments described herein. To this end, FIG. 1 is a perspective view of an example of a conventional prior art lighting system 100 utilizing strut members 124. The lighting system 100 can be suspended from a part of a structure, such as an I-beam 102 or another permanent part of the structure. Clamps 104 may support rods 106 relative to the I-beam 102. In some aspects, rods 106 may be fixed directly into concrete members or other permanent portions of the structure. The rods 106 may support strut hangers 108. The strut hangers 108 can support strut members 124. Various components can be attached to strut members 124 in a variety of configurations so as to achieve a desired infrastructure for the lighting system 100. In some arrangements, the strut members 124 may be all of uniform cross-sections and/or lengths. In other arrangements, different sizes of the strut members 124 can be used together. Although a conventional lighting system 100 is described above and depicted in FIG. 1 as being suspended from a structure, strut members 124 can also be utilized in various other arrangements, including free standing frames as may be useful in supporting electronic equipment such as computer servers and associated components.

Strut members 124 and associated connection pieces can be utilized to provide easily modifiable configurations for the lighting system 100. For example, strut members 124 may be joined by internally disposed pieces, such as T-splice 118. Strut members 124 can also be joined by other devices, such as junction pieces 120. A variety of external fixtures can also be mounted to the strut members 124. For example, fixture hangers 110 or fixture clamps 112 may be used to support conventional light fixtures—such as bar light 114 or canister lights 116—externally to the strut members 124. Strut members 124 may also support outlets 122 external to the strut member 124, such as for providing power to the conventional light fixtures or other fixtures. Connection pieces and fixtures may be readily moved relative to the strut members 124, thereby facilitating simplified modification or maintenance of the lighting system 100 without the use of welding or cutting operations.

Features herein are designed to be used with strut members, such as the strut members 124. Although the strut members 124 include slots 130, lateral holes (not shown) or other features may be provided for attaching objects to the strut member 124. These features can provide surfaces or other geometry to allow fasteners to pass through and/or engage portions of the inside or exterior of the strut member 124. In some prior art designs, a longitudinal cover 126 was provided with prongs for insertion into the slot 130 so as to cover the slot 130, such as for aesthetic purposes. In some other prior art designs, an end cover 128 can be provided so as to cover an end of the strut member 124 and/or close off the end of the strut member 124. As may be appreciated from the foregoing discussion, prior art strut members 124 are conventionally used to support fixtures positioned external to the strut members 124 with only accompanying wiring and/or fasteners routed through the interior of the strut members 124 when the strut members 124 are hollow.

Figure 2:
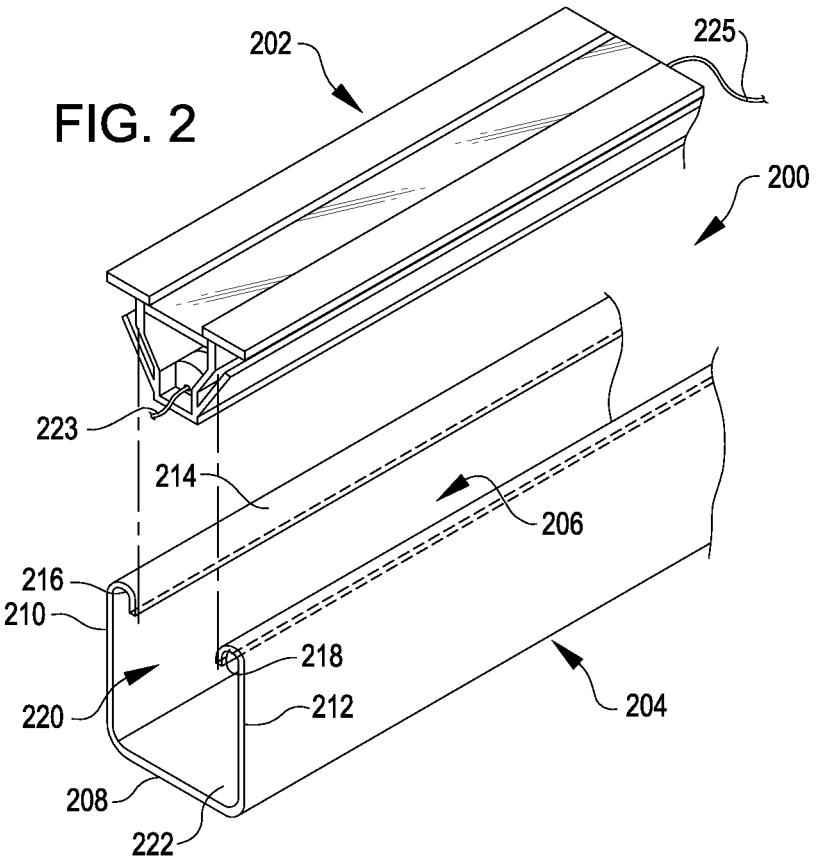
FIG. 2 is an exploded assembly view of a lighting system having a recessed lighting insert and a corresponding strut member according to a particular embodiment.

FIG. 2 is an exploded assembly view of a lighting system 200 incorporating embodiments herein. The lighting system 200 includes a lighting fixture insert 202 and a corresponding strut member 204. The strut member 204 can be a slotted elongate member, such as the prior art strut members described above, or can have a different structure. The example shown in FIG. 2 is a conventional strut structure, where the strut member 204 includes a rear 208, a first side 210, a second side 212, a front 214, a slot 206, a first lip 216, and second lip 218. Walls may be formed at the rear 208, the first side 210, the second side 212, and the front 214. The first side 210 and the second side 212 can be substantially parallel. The rear 208 can be positioned between the first side 210 and the second side 212. The rear 208 may include an inner face 222 facing an inside of the strut member 204. Walls of the first side 210 and the second side 212 can project from the rear 208 and join the walls of the rear 208 and the front 214. An interior volume 220 of the strut member 204 may be bounded by the rear 208 (e.g., the inner face 222), the first side 210, the second side 212, and the front 214 of the strut member 204, which generally form a rectangular cross section. In the embodiment of the strut member 204 shown in FIG. 2, the cross section is generally square, but alternate strut structures, where the height is not equal to the width, can be used. A slot 206 in the front 214 can define an entry into the interior volume 220. The slot 206 can be positioned opposite the inner face 222.

The slot 206 may be positioned and/or defined between the first lip 216 and the second lip 218. The first lip 216 and the second lip 218 may be inturned lips. For example, the first lip 216 and the second lip 218 can be directed toward an interior of the strut member 204. The first lip 216 and the second lip 218 can project toward the rear 208. According to varying aspects, the front 214 may include just the lips 216 and 218 or may include additional material extending from the walls of the sides 210 and 212 to the lips 216 and 218. In some aspects, the lips 216 and 218 may be considered to form part of the walls of the sides 210 and 212, such as a terminus of said walls, and the front 214 can be considered as a plane set flush against outermost edges of the lips 216 and 218.

Strut members 204 having combinations of features from the foregoing description are sometimes referred to as 'channels' or 'channel members' in correlation to the channel shape formed by the relative orientation of the first side 210, the rear 208, the second side 212, the slot 206, and the inturned lips 216 and 218. A number of such channel members are commercially available in varying shapes and materials. For example, commonly used materials include aluminum, steel, and fiberglass. Rectangular cross-sections are prevalent, with common widths of 4.127 cm, 3.175 cm, or 2.064 cm (1⅝ in., 1¼ in., or 13/16 in.) yielding such standard height by width dimensions as: 4.127×4.127 cm (1⅝×1⅝ in.), 8.255×4.127 cm (3¼×1⅝ in.), 2.064×4.127 cm (13/16×1⅝ in.), 2.064×2.064 cm (13/16×13/16 in.), 1.032×2.064 cm (13/32×13/16 in.), 3.175×3.175 cm (1¼×1¼ in.), 1.905×3.175 cm (¾×1¼ in.), etc.

Figure 3:
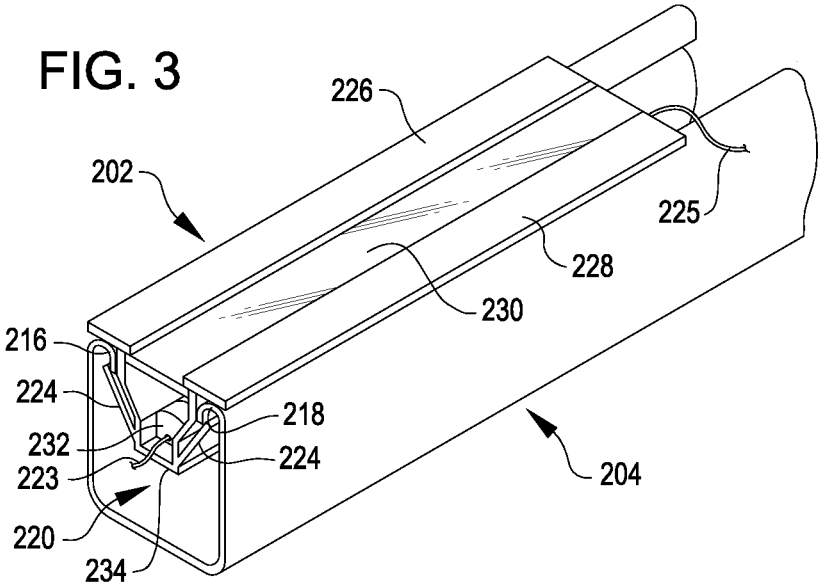
FIG. 3 is an assembled view of the components depicted in FIG. 2.

The lighting fixture insert 202 can be shaped and configured to be received by the strut or channel member 204. FIG. 3 is an assembled view of the components depicted in FIG. 2. The lighting fixture insert 202 can include a housing 234. The housing 234 can include structure 224 to engage the lips 216 and 218. For example, the structure 224 can extend behind the lips 216 and 218 and/or otherwise interfere with the lips 216 and 218. Non-limiting examples of the structure 224 include arms and prongs. Further examples of such structure 224 are described in greater detail below with reference to FIGS. 4-7.

The lighting fixture insert 202 can also include one or more structures to prevent the lighting fixture insert from falling too far into the strut member 204. For example, the lighting fixture insert 202 can include a first flange 226 and second flange 228. The flanges 226 and 228 can be made of any suitable material, including aluminum. The flanges 226 and 228 can abut the first lip 216 and the second lip 218 when the lighting fixture insert 202 is installed in the strut member 204. The housing 234 can also support or carry a light source 232. Non-limiting examples of the light source 232 include a light emitting diode (LED), an incandescent bulb, a fluorescent tube, and multiples and/or combinations thereof. The lighting fixture insert 202 may also include a cover 230. The cover 230 can permit light from the light source 232 to exit the strut member 204 when the lighting fixture insert 202 is installed in the strut member 204, such as in a direction away from the rear 208 and through the slot 206. For example, the cover 230 may include transparent or translucent material such as polycarbonate or frosted polycarbonate.

The lighting fixture insert 202 may extend a portion of the length of the strut member 204. In some aspects, such as depicted in FIGS. 2-3, the lighting fixture insert 202 extends a length that is less or more than the entire length of the strut member 204. For example, the strut member 204 may be a standardized channel member having a length of 3.048 meters (10 feet) and the lighting fixture insert 202 may be available in a variety of lengths, such as 0.3048 meter (1 foot), 1.829 meters (6 feet), 3.048 meters (10 feet), 2.743 meters (9 feet), or 3.658 meters (12 feet). The length of the lighting fixture insert 202 may be dependent on the width of the strut member 204. For example, a lighting fixture insert 202 may have a length that is at least 7 times the width of the strut member 204. As a particular example, a lighting fixture insert 202 that is 30.48 cm (1 foot or 12 in.) long may be provided for a strut member 204 having a width of 4.127 cm (1⅝ in.). In some aspects, the lighting fixture insert 202 can be sized so that the lighting fixture insert 202 can be included in the strut member 204 while still preserving room for hardware for affixing another fixture to the strut member 204.

The lighting fixture insert 202 can be configured so that it is substantially coplanar in an outer face with the front 214 of the strut member 204 when installed in the strut member 204. For example, the flanges 226 and 228 may provide a substantially planar outer face of the lighting fixture insert 202 that is substantially flush with the front 214 of the strut member 204. In some aspects, the cover 230 can be positioned so as to be secured by the flanges 226 and 228. For example, the cover 230 may be secured so as to be substantially coplanar with the front 214 of the strut member 204 when the housing 234 has been inserted into the slot 206. In some cases, the cover 230 is secured along an outer edge of the slot 206 by the flanges 226 and 228. Configuring a portion of the lighting fixture insert 202 to be substantially coplanar with the front 214 may allow the strut member 204 bearing the installed lighting fixture insert 202 to still be used as a support member for additional external fixtures. For example, the lighting fixture insert 202 might be used in place of the longitudinal cover 126 described above with respect to FIG. 1 without preventing the use of the fixture hangers 110, the strut hangers 108, or outlets 122.

The lighting fixture insert 202 may include one or more wires (such as wires 223 and/or 225) connected with the lighting fixture insert 202 to provide power thereto. In some aspects, the lighting fixture insert 202 includes a wire 223 routed through an end of the strut member 204. In some aspects, the lighting fixture insert 202 includes a wire 225 routed in between objects mounted to the strut member 204. For example, the wire 225 may exit the strut member 204 through the slot 206.

The base or housing 234 can be countersunk in the strut member 204 to provide a suitable position for the light source 232. For example, when the lighting fixture insert 202 is positioned in the strut member 204, the light source 232 can be recessed within the interior volume 220 such that light that emanates from the light source 232 will exit the strut member 204 through the slot 206. In some aspects, the base or housing 234 may also include a second fixture in addition to the light source 232. For example, a second recessed fixture might include a switch, an outlet, a power interface, a communication interface, a fan, a light source, or a sensor. As a specific example, a particular lighting fixture insert 202 may include a light source 232 and an outlet supported by a common housing 234 in the strut member 204. In some aspects, the outlet might be mounted in the housing 234 to supplement or replace the light source 232.

Figure 4:
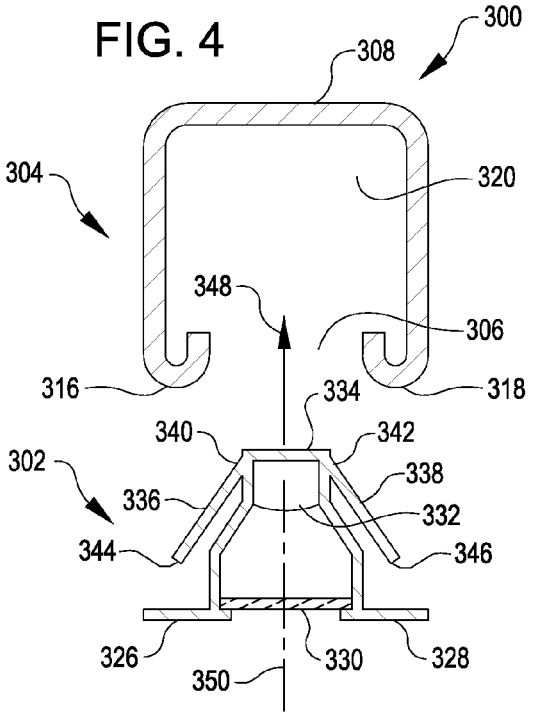
FIG. 4 is a cross-sectional view of a lighting system with a channel member and an un-inserted lighting fixture according to a particular embodiment.

FIG. 4 is a cross-sectional view of a lighting system 300 with a channel member 304 and an un-inserted recessed lighting fixture 302 according to a particular embodiment. The channel member 304 can be similar to the strut member 204 described above with respect to FIGS. 2 and 3. The recessed lighting fixture 302 can include a housing 334, flanges 326 and 328, a cover 330, and a light source 332 similar to components of the same name described above with respect to FIGS. 2 and 3. The recessed lighting fixture 302 can also include a first arm 336 and a second arm 338. The first arm 336 and the second arm 338 can be flexible and/or resilient. The first arm 336 and the second arm 338 may be flexible and/or resilient due to the material and/or the geometry of the first arm 336 and the second arm 338. A proximal end 340 of the first arm 336 can be connected with the housing 334. A proximal end 342 of the second arm 338 can be connected with the housing 334.

Figure 5:
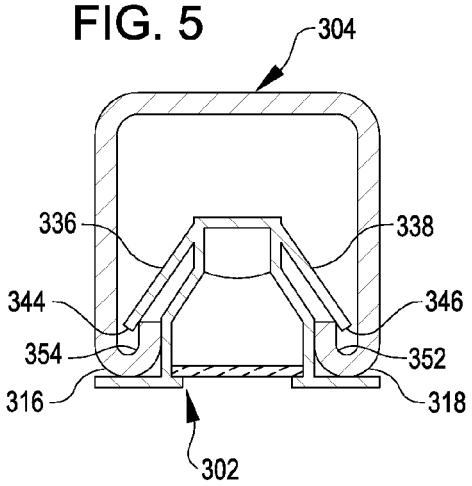
FIG. 5 is an assembled view of the components depicted in FIG. 4.

The recessed lighting fixture 302 can be inserted into the channel member 304 via a slot 306 in the channel member 304, as depicted by the arrow 348 in FIG. 4. FIG. 5 is an assembled view of the components depicted in FIG. 4. A flexibility of the first arm 336 and/or the second arm 338 can allow the arms 336, 338 to flex toward a central axis 350 of the housing 334 when the housing 334 is being inserted into the slot 306. When the housing 334 is fully pushed through the slot 306, resiliency of the arms 336 and 338 may cause the arms 336 and 338 to return to their unflexed state. In their unflexed state, the arms 336 and 338 can each be angled, respectively, to engage interiors 352 and 354 of the first and second inturned lips 316 and 318 of the channel member 304. For example, the distal end 344 of the first arm 336 can engage an interior 354 of the first lip 316 and the distal end 346 of the second arm 338 can engage an interior 354 of the second lip 318. Engagement of the arms 336 and 338 with the interiors 352 and 354 of the lips 316 and 318 can secure the housing 334 to the channel member 304.

When the recessed lighting fixture 302 has been fully inserted into the slot 306 of the channel member 304, the flanges 326 and 328 can abut the lips 316 and 318 on an exterior of the channel member 304. Abutment of the flanges 326, 328 with the lips 316 and 318 can additionally or alternatively secure the recessed lighting fixture 302 to the channel member 304.

In some aspects, the housing 334, the arms 336 and 338, and the flanges 326 and 328 can be a single extruded piece. For example, the housing 334, the arms 336 and 338, and the flanges 326 and 328 may be formed as a single piece of extruded aluminum. Such a unitary construction may provide heat dissipation for heat generated from the light source 232. In other aspects, the individual components can be assembled by any suitable process or device. For example, the arms 336 and 338 may be attached to the housing 334 via a hinge and a torsional spring can provide the resilience to cause the arms 336 and 338 to snap into a locking configuration behind the lips 316 and 318.

As may be appreciated by comparing FIGS. 4 and 5 with FIGS. 2 and 3, in many cases, a lighting fixture can be inserted into a channel member regardless of the orientation of the channel member relative to gravity. For example, the lighting fixture could be inserted upward into a channel member oriented with a downward-facing slot, or maybe inserted laterally into a laterally-facing slot or inserted downward into an upward-facing slot.

Figure 6:
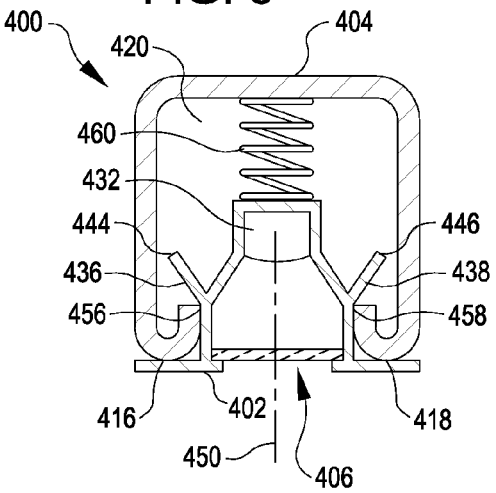
FIG. 6 is a cross-sectional view of another example of a lighting system with a lighting fixture inserted into a channel member according to a particular embodiment.

FIG. 6 is a cross-sectional view of another example of a lighting system 400 with a lighting fixture 402 inserted into a channel member 404 according to a particular embodiment. The lighting fixture 402 can differ from the recessed lighting fixture 302 in the placement and/or orientation of the arms 436 and 438. For example, the distal ends 444, 446 of the arms 436, 438 may be angled laterally from the slot 406 and into the interior volume 420 of the channel member 404. The arms 436 and 438 may angle away from the light source 432 and/or from a central access 450 of the lighting fixture 402 when in an unflexed position. Such an arrangement may allow the arms 436 and 438 to engage edges 456 and 458 of the inturned lips 416 and 418 of the channel member 404.

Furthermore, the lighting system 400 may include a spring 460. The spring 460 may bias the lighting fixture 402 into engagement with the lips 416 and 418. Although depicted in FIG. 6 with relation to lighting system 400, the spring 460 could additionally or alternatively be used in other arrangements described herein. In various arrangements, the spring 460 can be omitted.

Figure 7:
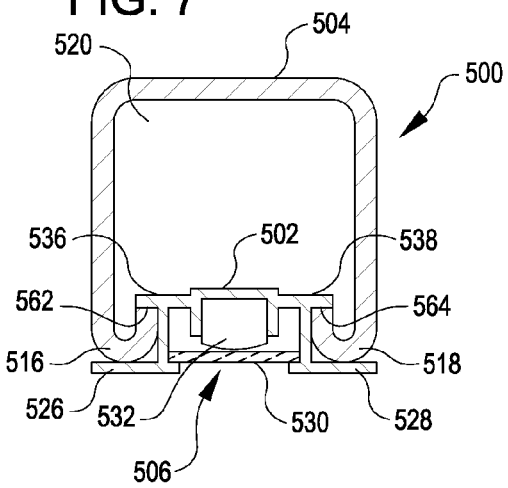
FIG. 7 is a cross-sectional view of a further example of a lighting system with a lighting fixture inserted into a channel member according to a particular embodiment.

FIG. 7 is a cross-sectional view of a further example of a lighting system 500 with a lighting fixture 502 inserted into a channel member 504 according to a particular embodiment, can include a lighting fixture 502 and a channel member 504. The lighting fixture 502 can differ from the lighting fixtures 402 and 302 depicted in FIGS. 4-6 in that the arms 536 and 538 can be arranged substantially parallel to the flanges 526 and 528. Such an arrangement can cause the arms 536 and 538 to abut inner rear-facing surfaces 562 and 564 on the inturned lips 516 and 518. Such abutment can attach the lighting fixture 502 to the channel member 504. As may be appreciated by comparing FIG. 7 to FIG. 6, in some aspects, the light source 532 can be positioned in various positions within the interior volume 520 of the channel member 504. Additionally, in some aspects, the cover 530 can be omitted or altered so that the light source 532 can be positioned partially extending through the slot 506 and at least partially within the interior volume 520.

Recessed lighting fixtures described herein may be inserted and/or removed according to various techniques. One example installation technique is depicted in FIG. 4, in which the recessed lighting fixture 302 is inserted by pressing the recessed lighting fixture 302 toward the rear 308 of the channel member 304, such as in the direction depicted by the arrow 348. Such an arrangement may cause the recessed lighting fixture 302 to pass at least partially from outside the interior volume 320 to inside the interior volume 320 through the slot 306 while engaging the channel member 304 during installation. In another example installation technique, the lighting fixture 502 depicted in FIG. 7 (or other lighting fixtures described herein) can be installed by sliding the lighting fixture 502 into an end of the channel member 504 (e.g., in a direction into or out of the page with respect to FIG. 7). The lighting fixture 502 can be slid along the slot 506 in a longitudinal direction of the channel member 504 so as to occupy the slot 506.

In some aspects, a lighting fixture may be removed or uninstalled by reversing the installation process used to install the lighting fixture. For example, the lighting fixture 502 may be removed in an uninstalling process by sliding the lighting fixture 502 out one of the ends of the channel member 504. Such a removal technique may be utilized regardless of the installation technique performed. For example, the recessed lighting fixture 302 depicted in FIG. 5 could be removed by sliding the recessed lighting fixture 302 out an end of the channel member 304 (e.g., in a direction into or out of the page with respect to FIG. 5). A further removal technique may be explained with reference to FIG. 6. Removing the lighting fixture 402 may involve prying the lighting fixture 402 from the channel member 404. For example, the lighting fixture 402 may be pried loose from the slot 406 by inserting a screwdriver or other suitable tool between a flange 416/418 and the channel member 404 and applying a prying force to urge the lighting fixture 402 to move out of the slot 406 and/or interior volume 420. Exertion of such a prying force on the lighting fixture 402 may cause the arms 436 and 438 to flex inward toward a central access 450 of the lighting fixture 402. Flexing of the arms 436 and 438 can allow the lighting fixture 402 to disengage from the channel member 404 through the slot 406. Accordingly, as may be appreciated from the foregoing discussion, attaching a recessed lighting fixture to a channel member may include snapping the lighting fixture into place through a slot in the channel member. Additionally, removing the lighting fixture may include at least one of sliding the fixture out an end of the channel or prying or pulling the lighting fixture out through the slot in the channel member.

Based on the disclosure and teachings provided herein, a person of ordinary skill in the art will appreciate other ways and/or methods to implement the various embodiments. The specification and drawings are, accordingly, to be regarded in an illustrative rather than a restrictive sense. It will, however, be evident that various modifications and changes may be made thereunto without departing from the broader spirit and scope of the disclosure as set forth in the claims.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the disclosure to the specific form or forms disclosed, but on the contrary, the intention is to cover all modifications, alternative constructions and equivalents falling within the spirit and scope of the disclosure, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the disclosure and does not pose a limitation on the scope of the disclosure unless otherwise claimed. No language in the specification should be construed as indicating any non-claimed element as essential to the practice of the disclosure.

Preferred embodiments of this disclosure are described herein, including the best mode known to the inventors for carrying out the disclosure. Variations of those preferred embodiments may become apparent to those of ordinary skill in the art upon reading the foregoing description. The inventors expect skilled artisans to employ such variations as appropriate and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

All references, including publications, patent applications and patents, cited herein are hereby incorporated by reference to the same extent as if each reference were individually and specifically indicated to be incorporated by reference and were set forth in its entirety herein.

What is claimed is:

1. A lighting system comprising:

a strut member comprising:

an interior volume;

a first inturned lip that is inturned into the interior volume;

a second inturned lip that is inturned into the interior volume; and a slot disposed between the first inturned lip and the second inturned lip and defining an entry into the interior volume of the strut member; and a recessed lighting fixture comprising:

a base that includes a mounting section, a first extension, a second extension, a first arm, a second arm, a first flange, and a second flange integrally formed of a single piece of material, wherein the first extension and the second extension extend from the mounting section to define a channel having a mouth, wherein the first arm extends from an outside of the first extension and the second arm extends from an outside of the second extension, wherein the first flange extends from a terminus of the first extension and away from the mouth, wherein the second flange extends away from a terminus of the second extension and away from the mouth, the first arm and the second arm respectively interfering with portions of the first inturned lip and the second inturned lip that face at least partially away from the slot so as to attach the base to the strut member when the base has been inserted into the slot, the first flange and the second flange respectively abutting exteriors of the first inturned lip and the second inturned lip such that the first inturned lip is captured between the first arm and the first flange and such that the second inturned lip is captured between the second arm and the second flange; and a light emitting diode (LED) mounted in the mounting section of the base such that the LED is supported relative to the strut member by the arms of the base so as to be positioned within the interior volume when the base is attached to the strut member.

2. The lighting system of claim 1, wherein the strut member further comprises:

an inner face opposite the slot;

a first sidewall projecting from the inner face and including the first inturned lip; and a second sidewall projecting from the inner face and including the second inturned lip, wherein the interior volume of the strut member is bounded by the inner face, the first sidewall, and the second sidewall.

3. The lighting system of claim 1, wherein the base is countersunk in the strut member when the base has been inserted into the slot such that light from the LED emanates toward an exterior of the strut member through the slot from within the interior volume when the base has been inserted into the slot.

4. The lighting system of claim 1, further comprising a second fixture supported by the strut member and positioned external to the internal volume of the strut member.

5. The lighting system of claim 4, wherein the second fixture comprises at least one of a switch, an outlet, a power interface, a communication interface, a fan, a lighting fixture, a light, or a sensor.

6. The lighting system of claim 1, further comprising a second fixture supported by the strut member and positioned at least partially within the internal volume of the strut member.

7. A fixture for a channel member, the channel member including a rear, a front having a slot defined therethrough by lips projecting from the front toward the rear, and two parallel sides joining the front and the rear, the fixture comprising:

a housing comprising a mounting section, extensions, arms, and flanges formed of a single piece of material, the extensions extending from the mounting section to define a channel having a mouth, the arms extending from outsides of the extensions, the flanges extending from the extensions away from the mouth, the housing being attachable to the channel member by the arms extending behind the lips and engaging portions of the lips that face at least partially away from the slot, wherein the flanges abut an exterior of the front of the channel member when the housing is attached to the channel member such that the lips are captured between the flanges and the arms; and an electronic fixture supported by the mounting section of the housing such that the electronic fixture is supported relative to the channel member by the arms of the base extending behind the lips so as to be disposed between the front and the rear of the channel member when the housing is attached to the channel member, wherein the electronic fixture comprises a light source arranged relative to the housing such that light from the light source emanates in a direction away from the rear through the slot when the housing has been attached to the channel member.

8. The fixture of claim 7, wherein the flanges comprise a first flange and a second flange.

9. The fixture of claim 8, wherein the structure extending behind the lips includes a first arm and a second arm each comprising material sufficiently flexible for the arm to flex toward a central axis of the housing when being inserted into the slot and sufficiently resilient to return toward an unflexed configuration after passing through the slot.

10. The fixture of claim 9, wherein the lips comprise a first inturned lip and a second inturned lip, wherein the first arm and the second arm are each connected with the housing at a proximal end of the arm, the first and second arms each angled so as to respectively engage an interior of the first and second inturned lips at a distal end of the arm when the housing is attached to the channel member, wherein the housing is attached to the channel member via the engagement of the arms with the inturned lips and the abutment of the flanges with the exterior of the front of the channel member.

11. The fixture of claim 9, wherein the lips comprise a first inturned lip and a second inturned lip, wherein the first arm and the second arm are each connected with the housing at a proximal end of the arm, the first and second arms each angled laterally from the slot and into the interior volume so as to respectively engage edges of the first and second inturned lips at a distal end of the arm when the housing is attached to the channel member, wherein the housing is attached to the channel member via the engagement of the arms with the inturned lips and the abutment of the flanges with the exterior of the front of the channel member.

12. The fixture of claim 8, wherein the lips comprise a first inturned lip and a second inturned lip, wherein the arms extending behind the lips includes a first arm and a second arm each connected with the housing at a proximal end of the arm, the first and second arms each arranged substantially parallel to the flanges so as to respectively abut inner surfaces of the first and second inturned lips at a distal end of the arm when the housing is attached to the channel member, wherein the housing is attached to the channel member via the abutment of the arms with the inturned lips and the abutment of the flanges with the exterior of the front of the channel member.

13. The fixture of claim 8, wherein the fixture further comprises a cover permitting passage of light from the light source in a direction away from the rear of the channel through the slot, the cover secured by the first and second flanges so as to be substantially coplanar with the front of the channel member when the housing has been inserted into the slot.

14. The fixture of claim 13, wherein the fixture further comprises a second light source positioned such that light from the second light source emanates in a direction away from the rear of the channel through the slot and the cover when the housing has been inserted into the slot.

15. A lighting insert for a slotted elongate member, the lighting insert comprising:

a base comprising a mounting section, extensions, arms, and flanges formed of a single piece of material, the extensions extending from the mounting section to define a channel having a mouth, the arms extending from outsides of the extensions, the flanges extending from the extensions away from the mouth, the base releasably attached to the slotted elongate member at or along a slot that forms a passage from an exterior to an interior of the slotted elongate member, the base releasably attached by engagement of the arms with lip portions that face at least partially away from the slot such that the lip portions are captured between the flanges and the arms; and a light fixture comprising a light source supported by the mounting section of the base relative to the slotted elongate member by the engagement of the base with the lip portions such that the light source is positioned at least partially within the interior of the slotted elongate member when the base is attached to the slotted elongate member.

16. The lighting insert of claim 15, wherein the light fixture is recessed within the slotted elongate member when the base is attached to the slotted elongate member.

17. The lighting insert of claim 15, wherein the base has a length dimension in the direction of the slot of the slotted elongate member that is at least seven times greater than a width dimension of the slotted elongate member that is perpendicular to said length dimension.

18. The lighting insert of claim 15, further comprising a wire connected with the light fixture to provide power thereto, the wire routed through an end of the slotted elongate member.

19. The lighting insert of claim 15, further comprising a wire connected with the light fixture to provide power thereto, the wire routed through the slot in the slotted elongate member.

20. A method of installing a light fixture, the method comprising:

providing a light fixture having a lamp supported by a mounting section of a base, the base further including arms and flanges formed as a single piece of material with the mounting section, the extensions extending from the mounting section to define a channel having a mouth, the arms extending from outsides of the extensions, the flanges extending from the extensions away from the mouth;

providing a channel member comprising a slot forming an opening defined between lips directed toward an interior of the channel member and away from the opening; and attaching the light fixture to the channel by attaching the base at or along the slot via engagement of the arms with lip portions that face at least partially away from the slot such that the lips are captured between the arms and flanges and such that the lamp is supported relative to the channel member by the engagement of the base with the lip portions so as to be at least partially positioned within the interior of the channel member.

21. The method of claim 20, wherein attaching the light fixture includes snapping the light fixture into place.

22. The method of claim 20, further comprising removing the light fixture, wherein attaching the light fixture includes snapping the light fixture into place through a slot in the channel member; and wherein removing the light fixture includes at least one of sliding the light fixture out an end of the channel member or prying the light fixture out through a slot in the channel member.

23. The method of claim 20, further comprising removing the light fixture, wherein attaching the light fixture includes sliding the light fixture in an end of the channel member; and wherein removing the light fixture includes sliding the light fixture out an end of the channel member.

* * * * *